US007798229B2

(12) United States Patent
Vick, Jr. et al.

(10) Patent No.: US 7,798,229 B2
(45) Date of Patent: Sep. 21, 2010

(54) DUAL FLAPPER SAFETY VALVE

(75) Inventors: James D. Vick, Jr., Dallas, TX (US); Michael B. Vinzant, Carrollton, TX (US); James M. Williams, Grand Prairie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1032 days.

(21) Appl. No.: 11/041,393

(22) Filed: Jan. 24, 2005

(65) Prior Publication Data

US 2006/0162939 A1 Jul. 27, 2006

(51) Int. Cl.
*E21B 34/12* (2006.01)

(52) U.S. Cl. ..... 166/332.8; 166/386; 166/334.1

(58) Field of Classification Search ..... 166/386, 166/324, 332.7, 332.8, 334.1
See application file for complete search history.

(56) References Cited

U.S. PATENT DOCUMENTS

| | | | | |
|---|---|---|---|---|
| 3,094,170 | A | 6/1963 | Bourne, Jr. | |
| 3,713,485 | A * | 1/1973 | Holbert, Jr. | 166/321 |
| 4,128,106 | A | 12/1978 | Abercrombie | |
| 4,340,088 | A | 7/1982 | Geisow | |
| 4,411,316 | A | 10/1983 | Carmody | |
| 4,478,286 | A * | 10/1984 | Fineberg | 166/324 |
| 4,846,281 | A * | 7/1989 | Clary et al. | 166/373 |
| 4,926,945 | A * | 5/1990 | Pringle et al. | 166/321 |
| 5,145,005 | A * | 9/1992 | Dollison | 166/332.8 |
| 5,310,005 | A * | 5/1994 | Dollison | 166/332.1 |
| 5,564,675 | A | 10/1996 | Hill, Jr. et al. | |
| 5,819,853 | A | 10/1998 | Patel | |
| 6,196,261 | B1 | 3/2001 | Dennistoun | |
| 6,227,299 | B1 | 5/2001 | Dennistoun | |
| 6,401,824 | B1 * | 6/2002 | Musselwhite et al. | 166/327 |
| 7,168,492 | B2 * | 1/2007 | Laplante et al. | 166/319 |
| 7,178,600 | B2 * | 2/2007 | Luke et al. | 166/373 |
| 2002/0033262 | A1 | 3/2002 | Musselwhite et al. | |

(Continued)

FOREIGN PATENT DOCUMENTS

| | | |
|---|---|---|
| GB | 336323 | 10/1930 |

(Continued)

OTHER PUBLICATIONS

U.K. Search Report for GB0417116.1.

(Continued)

*Primary Examiner*—Shane Bomar
(74) *Attorney, Agent, or Firm*—Marlin R. Smith

(57) ABSTRACT

A valve system for use in a subterranean well, the valve having multiple closure devices, or a closure device and a device for protecting the closure device. A valve system includes a valve with a closure assembly. The closure assembly has a closure device and a protective device which alters fluid flow through a flow passage of the valve prior to closure of the closure device to thereby protect the closure device. A safety valve system includes a safety valve with a closure assembly having at least two closure devices arranged in series for controlling flow through a flow passage of the safety valve. Another safety valve system includes a safety valve assembly including multiple safety valves arranged in parallel. One portion of fluid from a fluid source flows through one of the safety valves, while another portion of fluid from the fluid source flows through another safety valve.

21 Claims, 9 Drawing Sheets

U.S. PATENT DOCUMENTS

| | | | | |
|---|---|---|---|---|
| 2003/0000582 | A1 | 1/2003 | Jackson | |
| 2003/0047314 | A1* | 3/2003 | Allamon | 166/332.8 |
| 2003/0150621 | A1* | 8/2003 | Pia | 166/373 |
| 2003/0155131 | A1 | 8/2003 | Vick, Jr. | |
| 2003/0173091 | A1* | 9/2003 | Horne et al. | 166/386 |
| 2004/0079531 | A1* | 4/2004 | Smith et al. | 166/373 |

FOREIGN PATENT DOCUMENTS

| | | | |
|---|---|---|---|
| GB | 772690 | | 4/1957 |
| GB | 811237 | | 4/1959 |
| GB | 2220963 | A | 1/1990 |
| WO | 9855732 | A | 12/1998 |

OTHER PUBLICATIONS

Baker. Oil Tools, "Baker 'M' Series Non-Elastomeric Valves" informational publication, undated.

International Preliminary Report on Patentability and Written Opinion issued Aug. 2, 2007, for International Patent Application Serial No. PCT/US2005/046166, 8 pages.

* cited by examiner

DUAL FLAPPER SAFETY VALVE

BACKGROUND

The present invention relates generally to equipment utilized and operations performed in conjunction with a subterranean well and, in an embodiment described herein, more particularly provides a safety valve with multiple closure devices, or a closure device and a device for enhancing performance of the closure device.

Most safety valve failures are due to leakage past a closure device, such as a flapper or ball closure, of the safety valve. One of the main causes of closure device leakage is damage due to slam closure (i.e., an extremely fast closing of the closure device due, for example, to closing the valve during high velocity gas flow through the valve, etc.). Slam closures can also cause damage to a flow tube or opening prong of the safety valve, and to a pivot for the closure device. Another cause of closure device leakage is erosion due to high velocity flow past sealing surfaces on the closure device and its seat.

Therefore, it will be appreciated that it would be beneficial to reduce the damage due to slam closures and high velocity flow through a safety valve. It is accordingly one of the objects of the present invention to provide such damage reduction. Other objects of the invention are described below.

SUMMARY

In carrying out the principles of the present invention, a valve system is provided which solves at least one problem in the art. One example is described below in which the valve system includes multiple closure devices. Another example is described below in which the valve system includes a closure device and a protective device for protecting the closure device.

In one aspect of the invention, a valve system for use in a subterranean well is provided. The system includes a valve with a closure assembly. The closure assembly includes a closure device and a protective device. The protective device alters fluid flow through a flow passage of the valve prior to closure of the closure device to thereby protect the closure device.

In another aspect of the invention, a safety valve system is provided which includes a safety valve with a closure assembly. The closure assembly includes multiple closure devices for selectively permitting and preventing flow through a flow passage of the safety valve. The closure devices regulate flow through the passage in series.

In yet another aspect of the invention, a safety valve system is provided which includes a safety valve assembly with multiple safety valves arranged in parallel. One portion of fluid from a fluid source flows through one of the safety valves, while another portion of fluid from the fluid source flows through another safety valve. Actuation of the safety valves may be sequenced.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
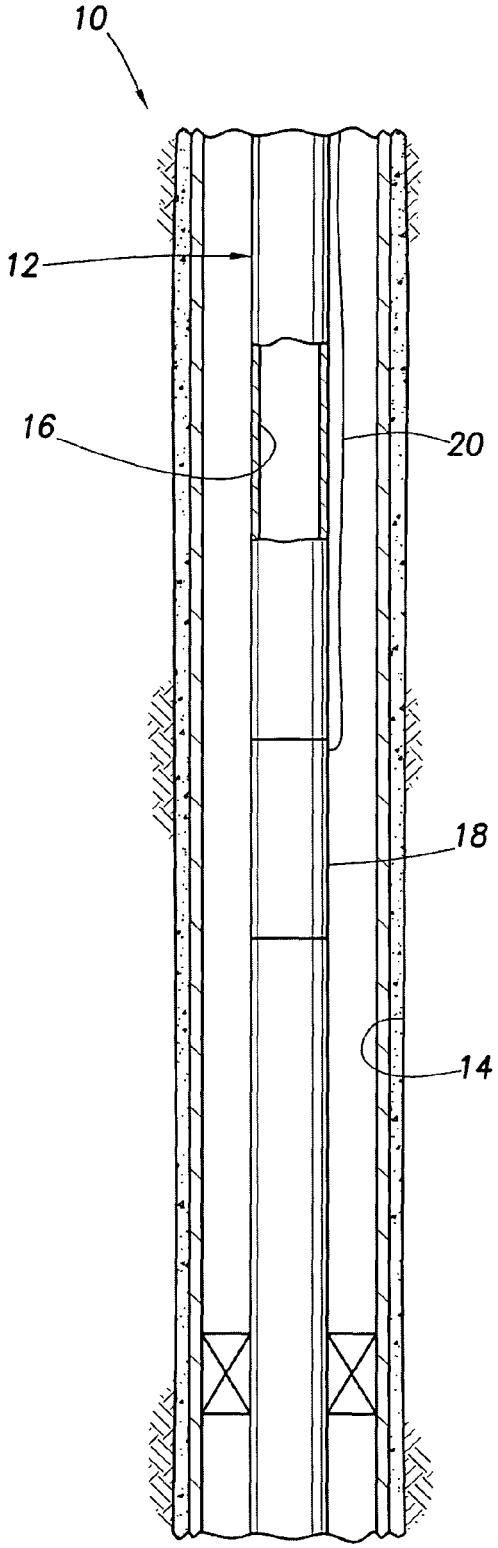
FIG. 1 is a schematic partially cross-sectional view of a safety valve system embodying principles of the present invention.

Representatively illustrated in FIG. 1 is a safety valve system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 has been positioned within a wellbore 14 of a subterranean well. The tubular string 12 has an internal flow passage 16 for producing fluid (e.g., oil, gas, etc.) from the well. A safety valve 18 is interconnected in the tubular string 12 to provide a means of shutting off flow through the passage 16 in the event of an emergency.

One or more lines 20, such as a hydraulic control line, are connected to the safety valve 18 to control actuation of the safety valve. Alternatively, the safety valve 18 could be actuated using electrical lines, optical lines, or other types of lines. As another alternative, the safety valve 18 could be actuated using telemetry, such as acoustic, electromagnetic, pressure pulse, or another type of telemetry. Any method of actuating the safety valve 18 may be used in keeping with the principles of the invention.

Figure 2:
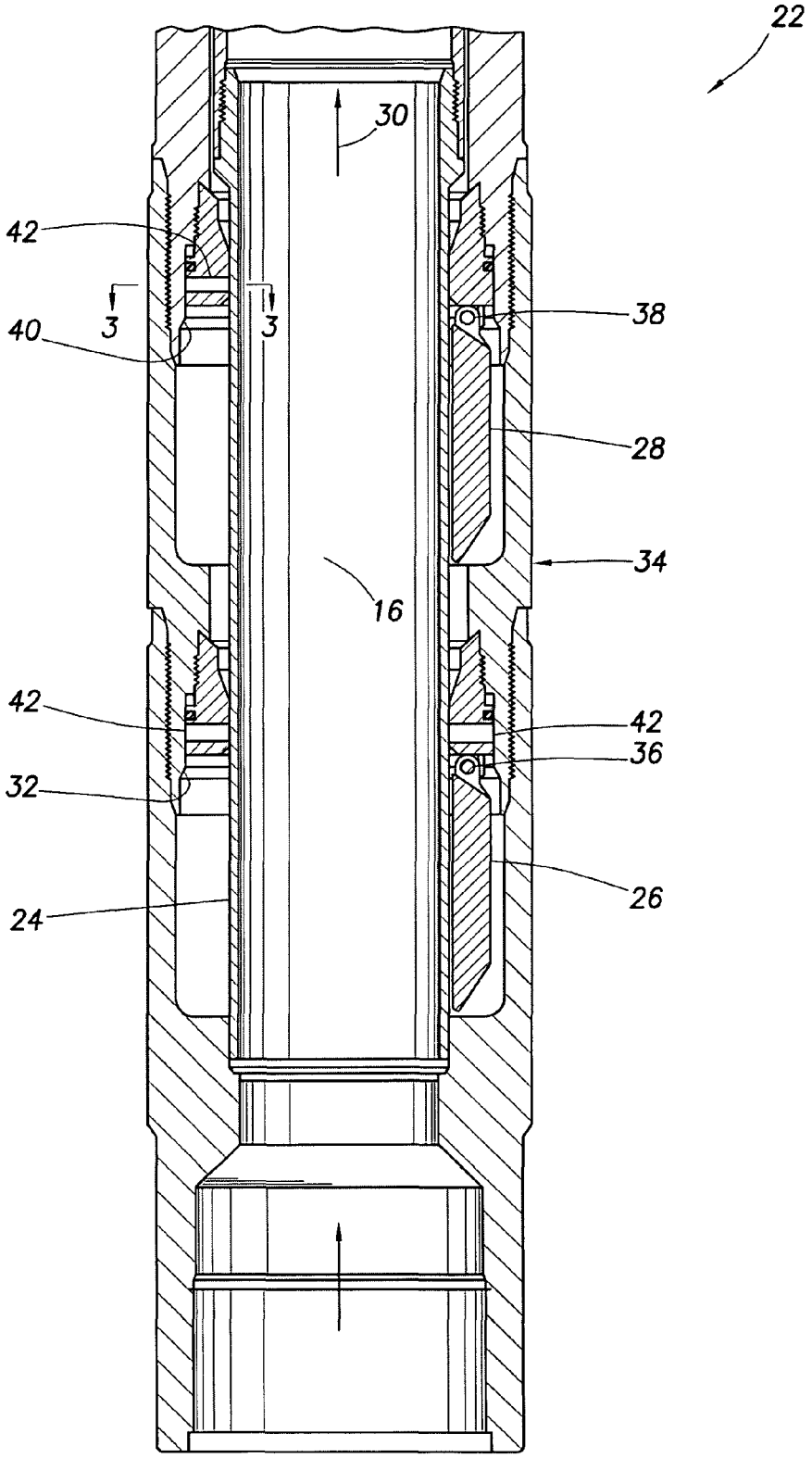
FIG. 2 is an enlarged scale cross-sectional view of a safety valve which may be used in the system of FIG. 1.

Referring additionally now to FIG. 2, a lower portion of a safety valve 22 is representatively illustrated. The safety valve 22 may be used for the safety valve 18 in the system 10, or it may be used in other systems. If the safety valve 22 is used in the system 10, the passage 16 will extend completely longitudinally through the safety valve.

As depicted in FIG. 2, an opening prong or flow tube 24 of the safety valve 22 is downwardly displaced to thereby open a closure assembly 34 of the safety valve. The closure assembly 34 includes two devices 26, 28 which are pivoted downward about respective pivots 36, 38 by the flow tube 24 to permit flow through the passage 16. The device 26 is positioned upstream of the device 28 relative to flow 30 through the passage 16.

The devices 26, 28 are representatively illustrated as being flappers. However, other types of devices, such as balls, etc., may be used in keeping with the principles of the invention.

Upward displacement of the flow tube 24 will permit the upstream device 26 to pivot upwardly and block flow through the passage 16 prior to the downstream device 28 pivoting upwardly. When the upstream device 26 pivots upwardly, it may sealingly engage a seat 32 and prevent flow through the passage 16. In that case, further upward displacement of the flow tube 24 will allow the downstream device 28 to pivot upward and sealingly engage a seat 40 with no, or reduced, pressure differential across the device.

In this manner, the upstream device 26 may function to protect the downstream device 28 against damage due to a high velocity closure of the downstream device. If the upstream device 26 seals off against the seat 32, then the upstream and downstream devices provide redundant sealing off of the flow 30 through the passage 16. If one of the devices 26, 28 should leak, the other device is available to prevent flow 30 through the passage 16.

In this manner, both of the devices 26, 28 may function as closure devices in the closure assembly 34. Note that it is not necessary for the devices 26, 28 to be the same type of closure device, if both are closure devices. For example, the upstream device 26 and seat 32 could form a metal-to-metal seal, while the downstream device 28 and/or seat 40 could instead, or in addition, use a resilient seal.

The metal-to-metal seal would be more robust for handling high flow rates and pressure differentials during closure (although perhaps more susceptible to leakage), while the resilient seal would be more leak resistant (although more susceptible to damage caused by high flow rates and pressure differentials). Thus, by separating a relatively high flow rate and pressure differential closure (at the upstream device 26) from a relatively low or no flow rate and pressure differential closure (at the downstream device 28), the seal(s) used at each device can be optimized for the individual application.

However, it should be clearly understood that it is not necessary for both of the devices 26, 28 to seal off the flow 30 through the passage 16. For example, the upstream device 26 could only substantially or partially block or restrict the flow 30 through the passage 16 to thereby reduce a pressure differential across the device 28, reduce a flow rate through the passage, reduce a flow area of the passage, etc. when the device 28 closes.

In this manner, the device 26 can function as a protective device to eliminate, or at least substantially reduce, damage to the device 28 and other portions of the closure assembly 34 when the device 28 closes. Examples are described below in which an upstream device functions as a protective device in a closure assembly, but it should be understood that other types of protective devices may be used, and devices other than upstream devices may be used as protective devices, in keeping with the principles of the invention.

Figure 3:
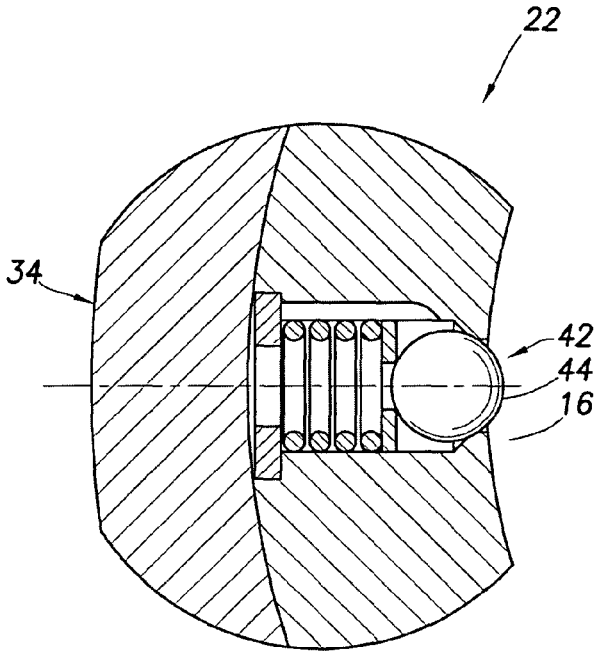
FIG. 3 is an enlarged scale cross-sectional view of an equalizing valve of the safety valve, taken along line 3-3 of FIG. 2.

Referring additionally now to FIG. 3, an equalizing valve 42 of the closure assembly 34 is representatively illustrated. Such equalizing valves are well known to those skilled in the art. In this case, the equalizing valve 42 resembles a check valve, except that a ball 44 of the valve protrudes somewhat into the passage 16 when the flow tube 24 is in its upper position.

Both of the devices 26, 28 are closed when the flow tube 24 is in its upper position, permitting a pressure differential to be created in the passage 16 across the closure assembly 34. That is, the devices 26, 28 would be pivoted upward and engaged with the seats 32, 40.

As the flow tube 24 displaces downward to open the valve 22, a lower end of the flow tube contacts the ball 44 and displaces it outward, thereby opening the equalizing valve 42. This opening of the equalizing valve 42 allows the pressures on either side of the device 28 to equalize prior to the flow tube 24 displacing further downward to pivot the device 28 downward. In this manner, the equalizing valve 42 helps to prevent damage to the flow tube 24, pivot 38, device 28, seat 40 or any other component which might be harmed by opening the device 28 against a large pressure differential.

In a conventional safety valve, this pressure equalizing process can be very time-consuming, and therefore expensive. For example, if a large volume of gas is in communication with the passage below a conventional safety valve, it could take many hours to bleed off the elevated gas pressure through a relatively small flow area equalizing valve.

In the safety valve 22, however, the equalizing valve 42 only needs to bleed off excess pressure in the passage 16 between the two devices 26, 28 if both devices function to seal off the passage. This relatively small volume can be readily equalized with the passage 16 above the device 28 in a matter of seconds after the equalizing valve 42 is opened.

After the pressures on either side of the device 28 have been equalized, the flow tube 24 is displaced further downward to pivot the device downward and thereby open the device. Still further downward displacement of the flow tube 24 causes the lower end of the flow tube to engage multiple equalizing valves 42 above the device 26. When opened by engagement with the flow tube 24, the equalizing valves 42 will relatively quickly equalize the pressures on either side of the device 26 prior to opening the device.

As depicted in FIG. 2, multiple equalizing valves 42 may be used above the device 26 in case a large volume of gas is in communication with the passage 16 below the device. By using multiple equalizing valves 42, the time required to equalize the pressures across the device 26 may be substantially reduced.

Multiple equalizing valves are not used in conventional safety valves, in part due to the fact that each equalizing valve presents a possible leak path. Thus, in a conventional safety valve, a compromise must be struck between increasing the number of leak paths and decreasing the time required to equalize pressure. In the safety valve 22, however, the downstream device 28 (with the single equalizing valve 42 above the device) serves as a redundant sealing device in the passage 16, so that leakage through one or more of the equalizing valves above the device 26 could occur without permitting flow through the passage which would result in failure of the safety valve.

This represents a significant improvement over conventional safety valves. Specifically, the pressure differentials in the passage 16 may be more quickly relieved by the equalizing valves 42 when opening the safety valve 22 as compared to conventional safety valves, without compromising the ability of the safety valve 22 to reliably shut off flow through the passage when the safety valve is closed.

It should be understood that it is not necessary to provide the multiple equalizing valves 42 above the upstream device 26 in keeping with the principles of the invention. In the situation where the upstream device 26 does not function to seal off the passage 16, use of the multiple equalizing valves 42 may not be beneficial.

Figure 4A:
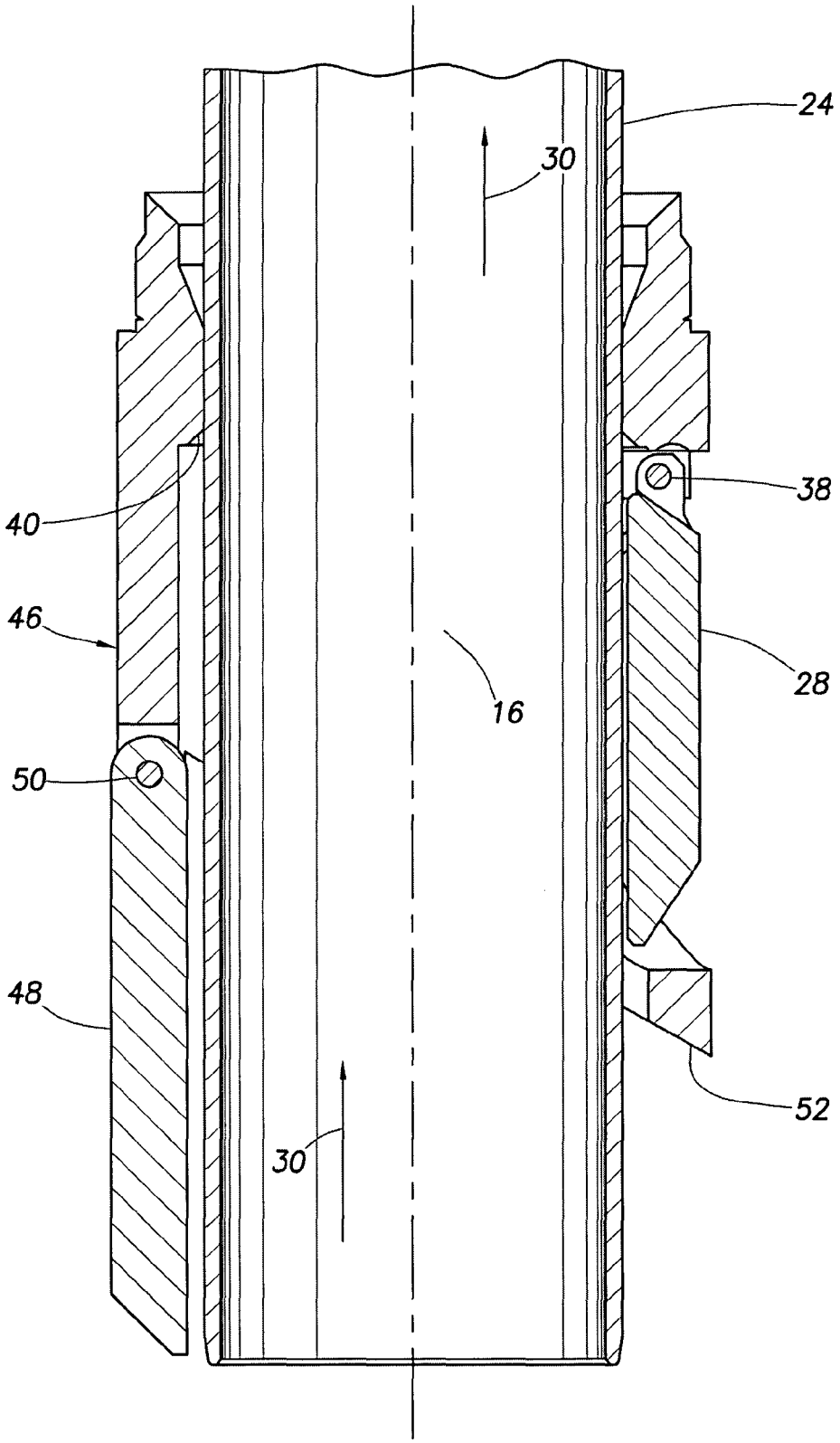
FIGS. 4A-C are cross-sectional views of a first alternate closure assembly which may be used in the safety valve of FIG. 2.
Figure 4B:
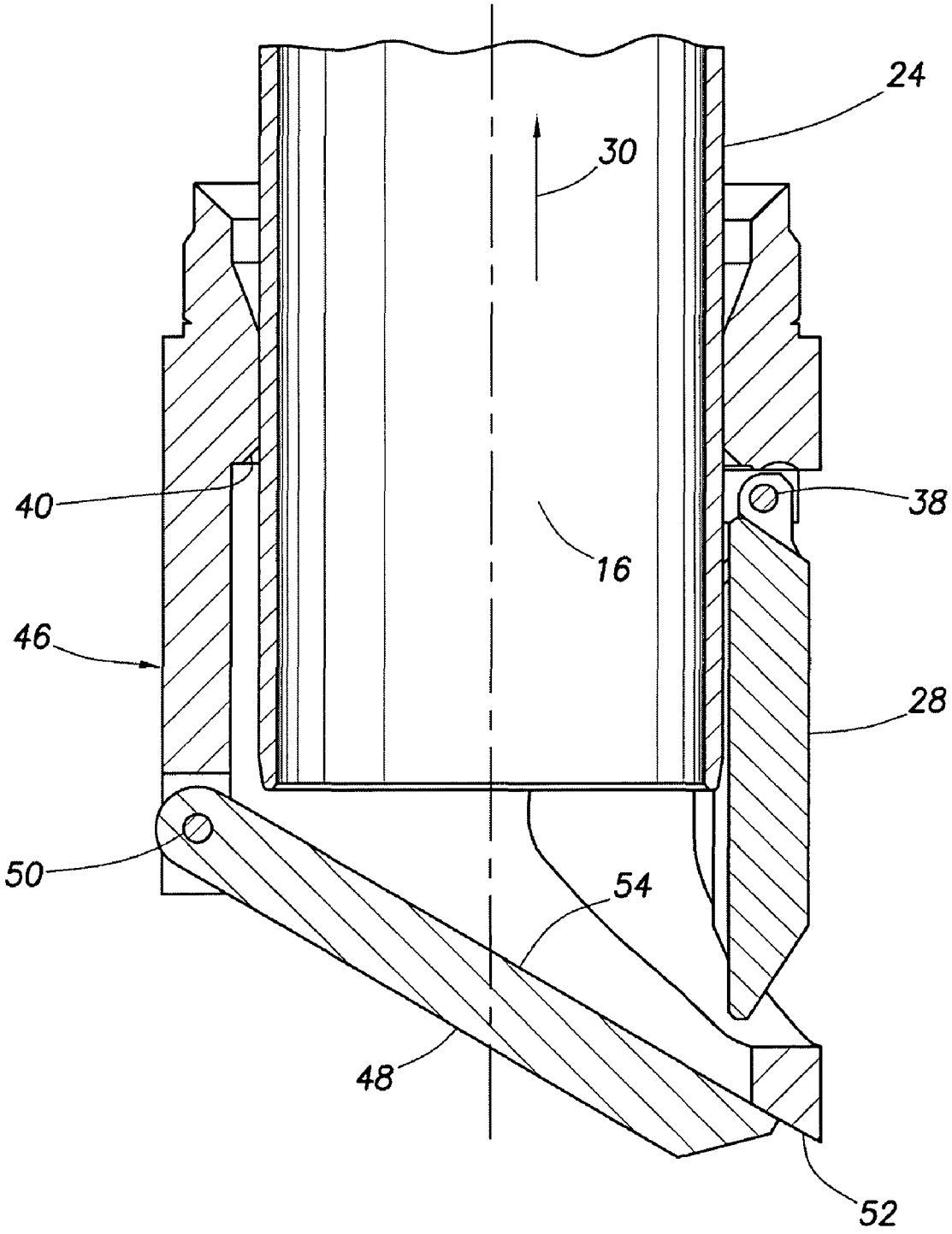
Figure 4C:
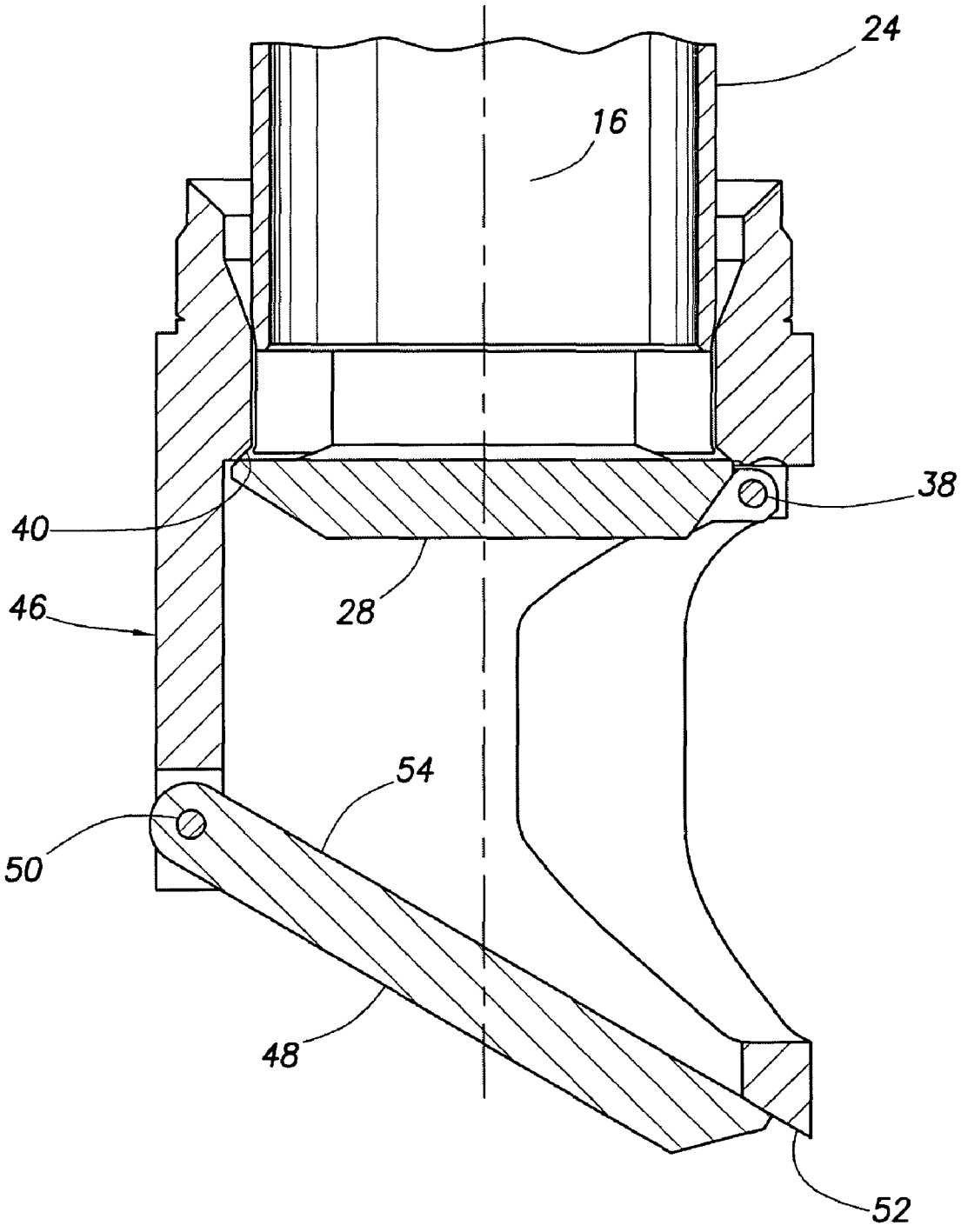

Referring additionally now to FIGS. 4A-C, an alternate closure assembly 46 which may be used in place of the closure assembly 34 in the safety valve 22 is representatively illustrated. The closure assembly 46 may be used in other types of safety valves in keeping with the principles of the invention.

The closure assembly 46 includes the downstream closure device 28 and associated pivot 38 and seat 40. However, instead of the upstream device 26 described above, the closure assembly 46 includes a device 48 which is configured as a flapper, but which preferably does not seal off the passage 16. The device 48 rotates about a pivot 50 and engages a laterally inclined surface 52 when the flow tube 24 displaces upward, but the engagement between the device and surface does not necessarily result in a seal being formed between these components, although such a seal could be formed in keeping with the principles of the invention.

In FIG. 4A the closure assembly 46 is depicted with the flow tube 24 in its downwardly disposed position. In this position, the flow tube 24 maintains the devices 28, 48 in their open positions, thereby allowing relatively unrestricted fluid flow 30 through the closure assembly 46.

In FIG. 4B the closure assembly 46 is depicted with the flow tube 24 displaced upward somewhat. In this position, the flow tube 24 allows the upstream device 48 to close by pivoting upward about the pivot 50 and engaging the surface 52.

In the closure assembly 34 described above, the pivots 36, 38 are on a same side of the closure assembly. However, in the closure assembly 46 the pivot 50 is positioned on an opposite lateral side from the pivot 38. In addition, by providing the inclined surface 52 for engagement by the device 48, the pivot 50 can be positioned laterally opposite the device 28, without the device 48 interfering with the pivoting movement of the device 28.

It will be appreciated that the positioning of the pivots 38, 50 on opposite sides of the closure assembly 46, with the pivot 50 being positioned opposite the device 28, provides a shorter stroke distance of the flow tube 24 to open and close the devices 28, 48. This shorter stroke distance makes the safety valve 22 more economical and efficient to manufacture, as well as providing significant benefits in construction of an actuator for the safety valve (such as increased buckling strength piston(s), etc.). An upper surface 54 of the device 48 could be concave (e.g., scalloped or dished out) to permit the device 48 to be moved upward (further downstream) and closer to the device 28 to thereby provide an even shorter stroke of the flow tube 24 without interfering with the pivoting movement of the device 28.

With the device 48 closed as depicted in FIG. 4B, the fluid flow 30 through the passage 16 is substantially reduced. If the device 48 sealingly engages the surface 52, then the fluid flow 30 could be entirely prevented. However, in the illustrated embodiment the fluid flow 30 is reduced (e.g., by significantly reducing a flow area of the passage 16 at the device 48), thereby reducing a flow rate through the passage, reducing a pressure differential across the device 28 when it is closed and reducing a torque on the device 28 about the pivot 38 due to impingement of the fluid flow on the device. In this manner, the device 48 functions as a protective device to prevent, or at least reduce, damage to the device 28, pivot 38, seat 40 and flow tube 24 which might result if the device 28 were closed in a high flow rate fluid flow 30.

Note that other types of devices could be used to reduce the flow rate of the fluid flow 30 prior to closing the device 28. For example, the device 48 could be configured as a ball rather than as a flapper, the device could be another type of flow restriction, or otherwise reduce the flow area of the passage 16, etc. Any means of reducing the flow rate through the passage 16, reducing a pressure differential across the device 28 when it closes, or reducing a torque on the device may be used in keeping with the principles of the invention.

In FIG. 4C the closure assembly 46 is depicted with the flow tube displaced upward sufficiently far to permit the device 28 to pivot upward and sealingly engage the seat 40. This seals off the passage 16, preventing all upward fluid flow through the passage. Due to the unique features of the closure assembly 46, the device 28 pivots upward while a reduced flow rate, reduced pressure differential and reduced torque on the device exist, thereby also preventing, or at least reducing, any damage to the closure assembly.

Figure 5A:
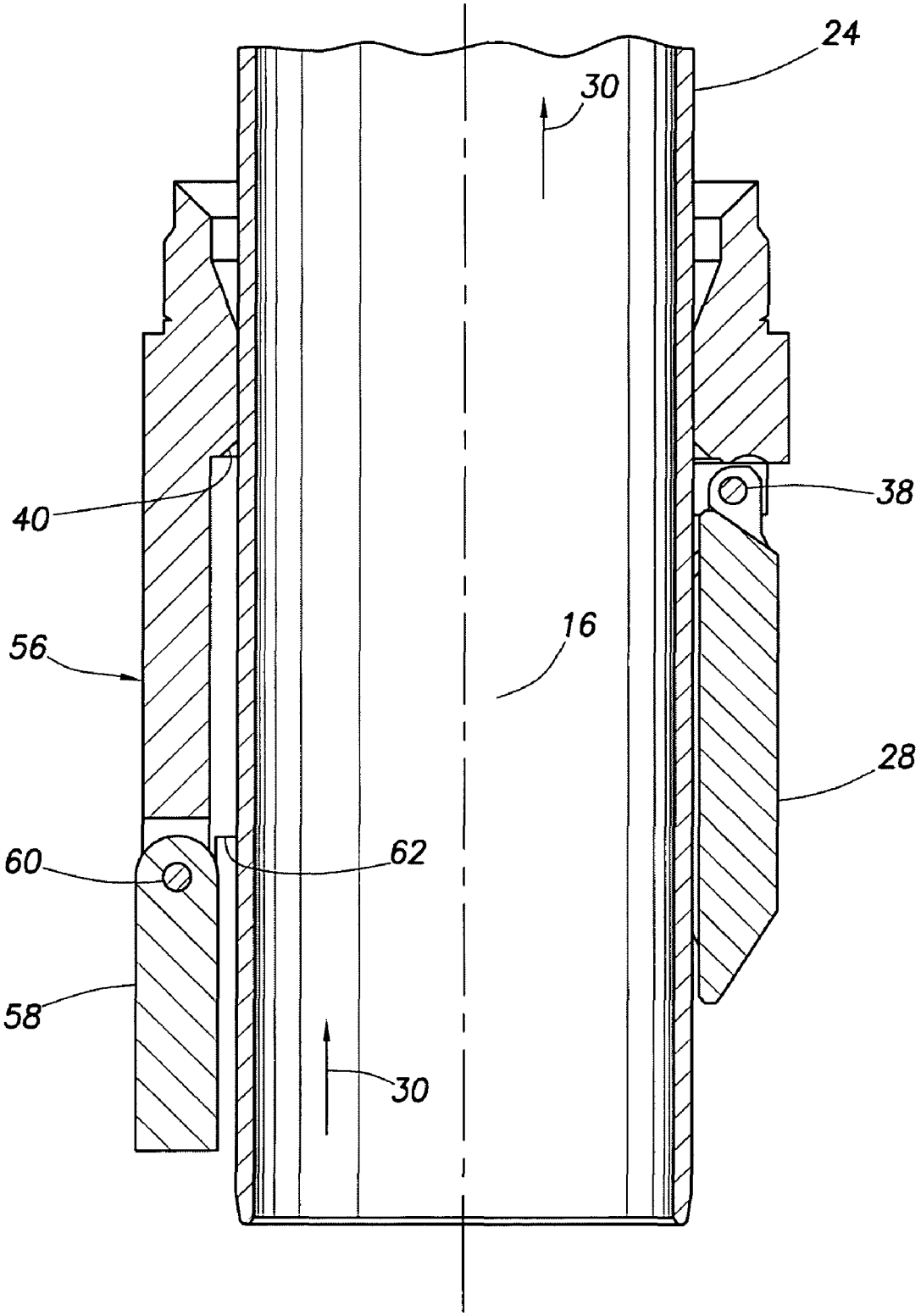
FIGS. 5A-C are cross-sectional views of a second alternate closure assembly which may be used in the safety valve of FIG. 2.
Figure 5B:
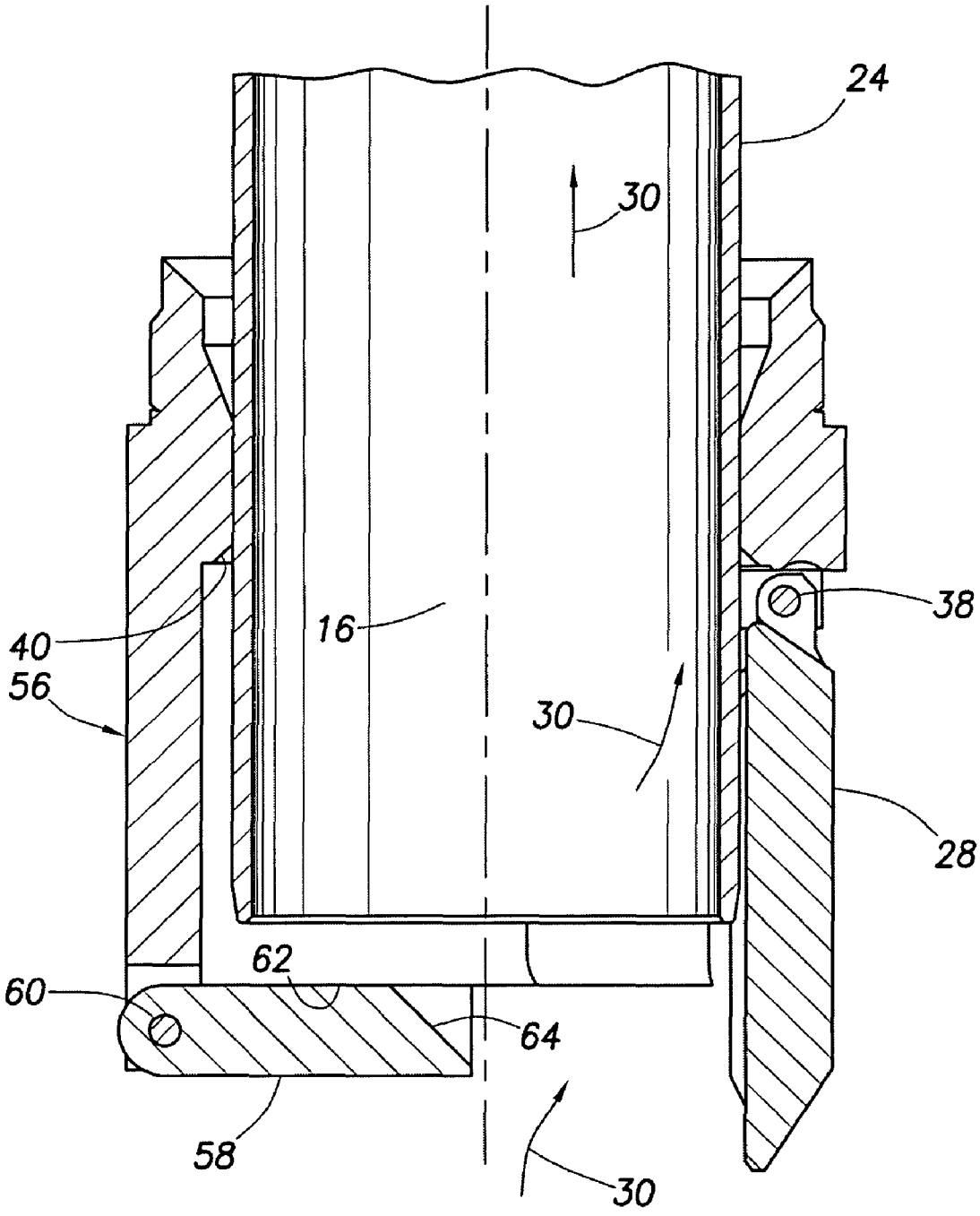
Figure 5C:
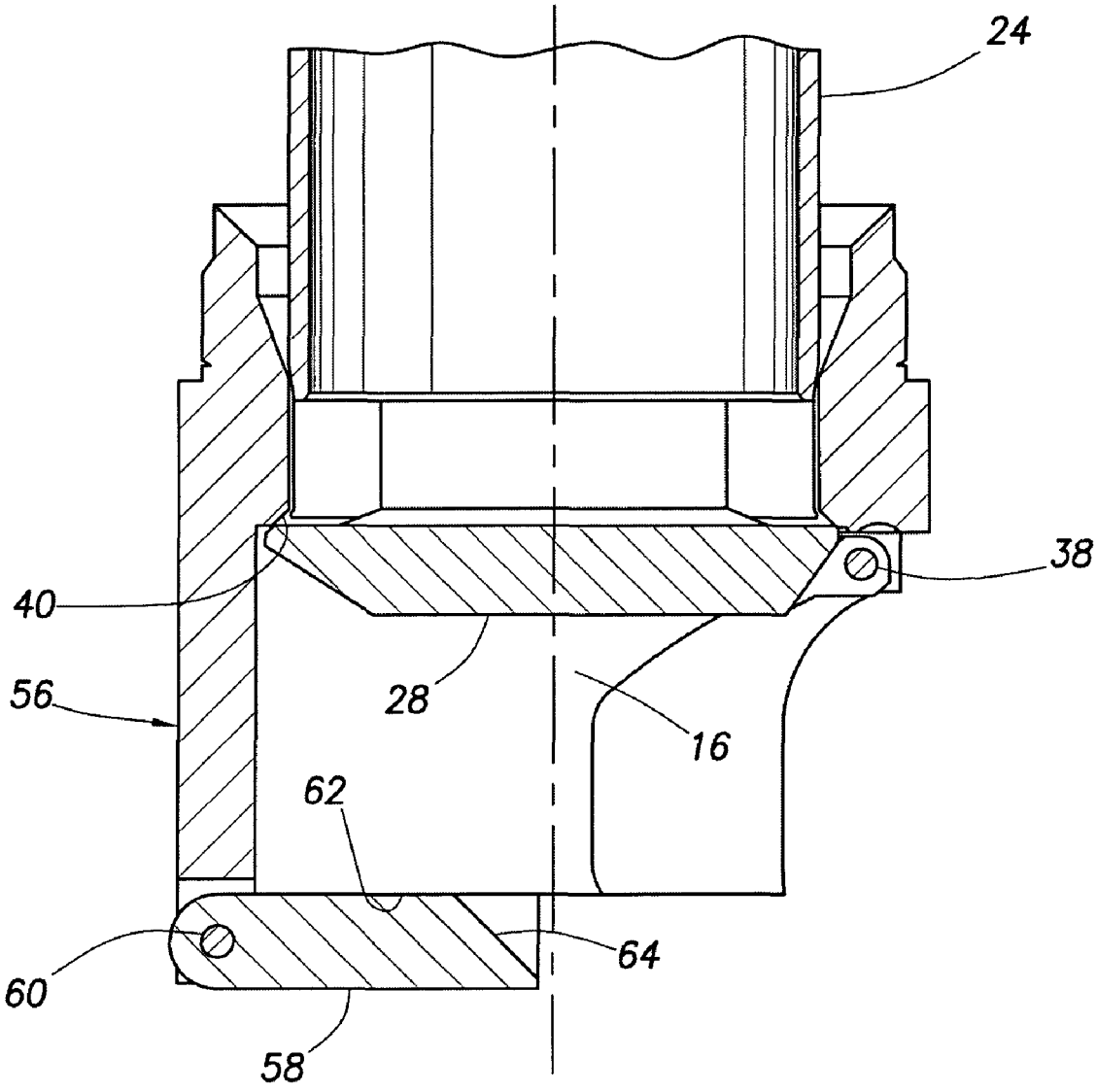

Referring additionally now to FIGS. 5A-C, another alternate configuration of a closure assembly 56 is representatively illustrated. The closure assembly 56 may be used in place of the closure assembly 34 in the safety valve 22. The closure assembly 46 may also be used in other types of safety valves in keeping with the principles of the invention.

The closure assembly 56 includes the downstream device 28, pivot 38 and seat 40 as described above for the closure assemblies 34, 46. However, the closure assembly 56 has an upstream device 58 which only partially closes off the passage 16 when it pivots upward. The device 58 is configured as a flapper which pivots about a pivot 60 and engages a surface 62 when the device pivots upward.

As depicted in FIG. 5A, the flow tube 24 is in its fully downwardly stroked position, maintaining the devices 28, 58 in their open positions. In this position of the flow tube 24, relatively unrestricted flow is permitted through the passage 16.

In FIG. 5B the closure assembly 56 is depicted with the flow tube 24 displaced upward sufficiently far for the device 58 to pivot upward and engage the surface 62. Note that the surface 62 is shown as being horizontal, or orthogonal to the passage 16, but it will be readily appreciated that the surface could be laterally inclined (as the surface 52 described above) if desired. An outer end 64 of the device 58 is concave (e.g., scalloped or dished out) to allow the device 58 to be positioned further downstream and closer to the device 28, without interfering with the pivoting movement of the device 28, thereby providing for a shorter stroke of the flow tube 24.

Note that in this position of the device 58 the flow area of the passage 16 is reduced only somewhat less than 50%. However, one significant benefit of the configuration of the device 58 and its positioning relative to the passage 61 is that in its closed position the device directs the fluid flow 30 toward the pivot 38 for the device 28. In this manner, the device 58 acts to reduce the torque applied to the device 28 when it closes by moving the impingement of the fluid flow 30 on the device 28 closer to the pivot 38.

Of course, the device 58 in its closed position also reduces the flow area of the passage 16 and forms a restriction to flow through the passage, thereby reducing the pressure differential across the device 28 when it closes and reducing a flow rate of the fluid flow 30, as well as further reducing the torque on the device 28 about the pivot 38 when the device closes. In this manner, the device 58 functions as a protective device to prevent, or at least reduce, damage to the closure assembly 56.

In FIG. 5C the closure assembly 56 is depicted with the flow tube 24 displaced upward sufficiently far to allow the device 28 to pivot upward and seal off the passage 16. The device 28 now sealingly engages the seat 40 and prevents upward fluid flow through the passage 16.

Note that many other ways of reducing the flow area of the passage 16 or forming an increased restriction to flow through the passage could be used in any of the closure assemblies 34, 46, 56 described above. For example, one or more openings could be formed through the upstream devices 26, 48, so that flow through the openings is significantly restricted when the devices are in their closed positions. Other types of flow restrictions, such as venturis, obstructions, tortuous paths, turbulence generators, etc. may be used in keeping with the principles of the invention.

Figure 6:
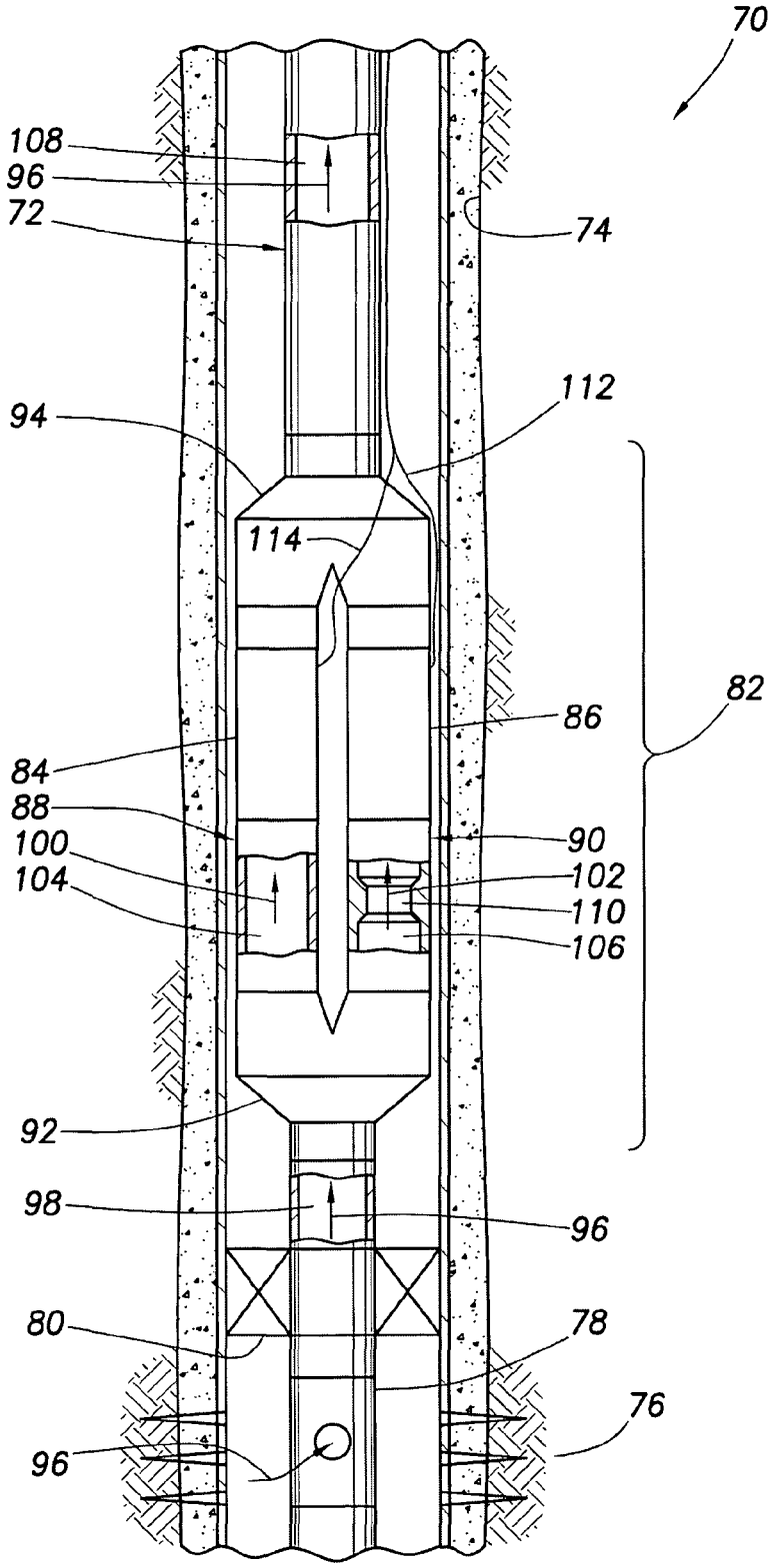
FIG. 6 is a schematic partially cross-sectional view of another safety valve system embodying principles of the present invention.

Referring additionally now to FIG. 6, another safety valve system 70 is representatively illustrated. As depicted in FIG. 6, a tubular string 72 has been installed in a wellbore 74 and placed in communication with a formation, zone, reservoir or other fluid source 76 via a production valve 78 interconnected in the tubular string below a packer 80.

The system 70 is of particular benefit when an anticipated rate of production from the source 76 is greater than that which can be safely or practically accommodated by a single conventional safety valve. For example, the source 76 could be a large gas cavern from which it is desired to flow gas at a rate exceeding that which could be sealed off by a convention safety valve without debilitating damage to the safety valve. Alternatively, or in addition, the desired flow rate could be greater than that which could be handled by the largest practical size of conventional safety valve.

The system 70 solves these problems by providing a safety valve assembly 82 which includes multiple safety valves 84, 86 uniquely interconnected in the tubular string 72. Although only two safety valves 84, 86 are illustrated in FIG. 6, it should be understood that any number of safety valves may be used in keeping with the principles of the invention.

The safety valve assembly 82 includes the safety valves 84, 86 interconnected in parallel tubular strings 88, 90. The tubular strings 88, 90 are interconnected to each other, and to the tubular string 72 above and below the safety valve assembly 82 by two wye connectors 92, 94.

Thus, fluid 96 produced from the source 76 enters the tubular string 72 and flows through a passage 98 of the tubular string below the safety valve assembly 82. The fluid 96 is divided among the tubular strings 88, 90 at the lower wye connector 92, so that a portion 100 of the fluid flows through a passage 104 of the tubular string 88, and another portion 102 of the fluid flows through a passage 106 of the tubular string 90. The fluid portions 100, 102 are recombined at the wye connector 94 above the safety valve assembly 82, so that the fluid 96 flows through a passage 108 of the tubular string 72 above the safety valve assembly.

In this manner, each of the safety valves 84, 86 only has to accommodate its respective portion 100, 102 of the fluid 96 flowing therethrough. It will be appreciated that the flow rate of each fluid portion 100, 102 may be substantially less than (e.g., 50% of) the flow rate of the fluid 96 through the tubular string 72 above or below the safety valve assembly 82.

One significant feature of the system 70 is the parallel flow of the fluid portions 100, 102 through the multiple safety valves 84, 86. The benefits of this feature can be obtained using various different configurations of the system 70. For example, it is not necessary for the fluid 96 to be divided by the wye connector 92 below the safety valve assembly 82. The parallel tubular strings 88, 90 could instead extend below the packer 80, so that the fluid 96 is divided when it enters the tubular strings.

It is also not necessary for the fluid portions 100, 102 to be recombined in the wye connector 94 above the safety valve assembly 82. The parallel tubular strings 88, 90 could instead extend upwardly to the surface or another remote location without being recombined.

Additional features may be used in the system 70 to prevent, or at least reduce, damage to the safety valves 84, 86. For example, any of the closure assemblies 34, 46, 56 described above could be used in either or both of the safety valves 84, 86. As another example, the tubular strings 88, 90 could be configured to appropriately restrict fluid flow through the respective passages 104, 106 (e.g., by sizing the tubular strings appropriately, or positioning a flow restriction 110 in either or both of the passages, etc.), so that flow rates through the safety valves 84, 86 are reduced. Note that the flow restriction 110 could be positioned upstream and/or downstream of either or both of the safety valves 84, 86.

As yet another example, closing of the safety valves 84, 86 could be sequenced to provide some control over the flow rate of the fluid portions 100, 102 through the respective safety valves 84, 86 at the time each is closed. The safety valve 84 could be closed first, followed by the safety valve 86. The flow restriction 110 in the tubular string 90 would limit the flow rate of the fluid 96 through the safety valve 86 at the time it is closed to thereby prevent, or at least reduce, damage to the safety valve.

This sequencing of the safety valves 84, 86 closing could be accomplished at the surface, at another remote location, downhole proximate the safety valves, as part of the construction of the safety valves, or at any other location. For example, if the safety valves 84, 86 are hydraulically actuated a hydraulic delay (such as in the form of a flow restricting orifice) could be used in a line 112 connected to the safety valve 86, while flow through a line 114 connected to the safety valve 84 would not be as restricted. Of course, it is not necessary in keeping with the principles of the invention for such a hydraulic delay to be used, and if the safety valves are otherwise actuated (such as electrically, by telemetry, etc.) then other types of delays or other sequencing methods may be used.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A valve system for use in a subterranean well, the system comprising:

a valve including a closure assembly, the closure assembly including a closure device and a protective device, the protective device altering fluid flow through a flow passage of the valve prior to closure of the closure device to thereby protect the closure device, and each of the closure device and the protective device being operable in response to displacement of a same actuator member.

2. The system of claim 1, wherein the protective device reduces a flow rate of the fluid flow through the passage prior to closure of the closure device.

3. The system of claim 1, wherein the protective device reduces a pressure differential across the closure device when the closure device is closed.

4. The system of claim 1, wherein the protective device directs the fluid flow toward a pivot for the closure device prior to closure of the closure device.

5. The system of claim 1, wherein the protective device reduces a torque resulting from impingement of the fluid flow on the closure device when the closure device is closed.

6. The system of claim 1, wherein the protective device reduces a flow area of the flow passage prior to closure of the closure device.

7. The system of claim 1, wherein the closure device comprises a flapper.

8. A valve system for use in a subterranean well, the system comprising:

a valve including a closure assembly, the closure assembly including a closure device and a protective device, the protective device altering fluid flow through a flow passage of the valve prior to closure of the closure device to thereby protect the closure device; and an equalizing valve for equalizing pressure across the closure device, the equalizing valve providing selective fluid communication with the flow passage between the closure device and the protective device.

9. A valve system for use in a subterranean well, the system comprising:

a valve including a closure assembly, the closure assembly including a closure device and a protective device, the protective device altering fluid flow through a flow passage of the valve prior to closure of the closure device to thereby protect the closure device; and multiple equalizing valves for equalizing pressure across the protective device.

10. The system of claim 9, wherein the equalizing valves equalize pressure across the protective device between opening of the closure device and opening of the protective device.

11. A safety valve system for use in a subterranean well, the system comprising:

a safety valve including a closure assembly, the closure assembly including at least first and second closure devices for selectively permitting and preventing flow through a flow passage of the safety valve, the first and second closure devices regulating flow through the passage in series, and each of the first and second closure devices being operable in response to displacement of a same actuator member, wherein closure of the first closure device prior to closure of the second closure device reduces a pressure differential across the second closure device.

12. The system of claim 11, wherein at least one of the first and second closure devices comprises a flapper.

13. The system of claim 11, wherein closure of the first closure device prior to closure of the second closure device reduces a flow rate through the second closure device.

14. The system of claim 11, wherein closure of the first closure device prior to closure of the second closure device reduces a torque applied to the second closure device due to flow through the passage.

15. The system of claim 11, wherein closure of the first closure device prior to closure of the second closure device directs flow toward a pivot for the second closure device.

16. The system of claim 11, wherein the first and second closure devices provide redundant sealing off of fluid flow through the flow passage.

17. A safety valve system for use in a subterranean well, the system comprising:

a safety valve including a closure assembly, the closure assembly including at least first and second closure devices for selectively permitting and preventing flow through a flow passage of the safety valve, the first and second closure devices regulating flow through the passage in series; and an equalizing valve for equalizing pressure across the second closure device, the equalizing valve providing selective fluid communication with the flow passage between the first and second closure devices.

18. A safety valve system for use in a subterranean well, the system comprising:

a safety valve including a closure assembly, the closure assembly including at least first and second closure devices for selectively permitting and preventing flow through a flow passage of the safety valve, the first and second closure devices regulating flow through the passage in series; and multiple equalizing valves for equalizing pressure across the first closure device.

19. The system of claim 18, wherein the equalizing valves equalize pressure across the first closure device between opening of the second closure device and opening of the first closure device.

20. A safety valve system for use in a subterranean well, the system comprising:

a safety valve including a closure assembly, the closure assembly including at least first and second closure devices for selectively permitting and preventing flow through a flow passage of the safety valve, the first and second closure devices regulating flow through the passage in series, and each of the first and second closure devices being operable in response to displacement of a same actuator member, wherein closure of the first closure device prior to closure of the second closure device reduces a flow rate through the second closure device.

21. A safety valve system for use in a subterranean well, the system comprising:

a safety valve including a closure assembly, the closure assembly including at least first and second closure devices for selectively permitting and preventing flow through a flow passage of the safety valve, the first and second closure devices regulating flow through the passage in series, and each of the first and second closure devices being operable in response to displacement of a same actuator member, wherein closure of the first closure device prior to closure of the second closure device reduces a torque applied to the second closure device due to flow through the passage.

* * * * *